US010707625B2

(12) United States Patent
Sakaizawa et al.

(10) Patent No.: US 10,707,625 B2
(45) Date of Patent: Jul. 7, 2020

(54) CONNECTOR

(71) Applicant: HIROSE ELECTRIC CO., LTD., Tokyo (JP)

(72) Inventors: Tadashi Sakaizawa, Tokyo (JP); Kenichi Naganuma, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 182 days.

(21) Appl. No.: 16/062,767

(22) PCT Filed: Nov. 10, 2016

(86) PCT No.: PCT/JP2016/083330
§ 371 (c)(1),
(2) Date: Jun. 15, 2018

(87) PCT Pub. No.: WO2017/104310
PCT Pub. Date: Jun. 22, 2017

(65) Prior Publication Data

US 2020/0099171 A1 Mar. 26, 2020

(30) Foreign Application Priority Data

Dec. 18, 2015 (JP) ..... 2015-246888

(51) Int. Cl.
*H01R 13/64* (2006.01)
*H01R 13/6473* (2011.01)
(Continued)

(52) U.S. Cl.
CPC ..... *H01R 13/6473* (2013.01); *H01R 13/40* (2013.01); *H01R 24/64* (2013.01); *H01R 2107/00* (2013.01)

(58) Field of Classification Search
CPC ..... H01R 13/6473; H01R 13/40; H01R 24/64
(Continued)

(56) References Cited

U.S. PATENT DOCUMENTS 5,199,885 A * 4/1993 Korsunsky ..... H01R 12/737 439/79
5,238,414 A * 8/1993 Yaegashi ..... H01R 12/716 439/108
(Continued)

FOREIGN PATENT DOCUMENTS

CN 2491977 Y 5/2002
CN 2665962 Y 12/2004
(Continued)

OTHER PUBLICATIONS

International Search Report dated Jan. 31, 2017 filed in PCT/JP2016/083330.
(Continued)

*Primary Examiner* — Alexander Gilman
(74) *Attorney, Agent, or Firm* — Rankin, Hill & Clark LLP

(57) ABSTRACT

In a typical connector, multiple terminals are not arranged at regular intervals on the same plane. Thus, impedance matching for transferring a high-frequency electric signal cannot be established, leading to problems such as lowering of high-frequency characteristics. For solving these problems, a connector is provided. The connector is a substrate-side connector including multiple terminals arranged in parallel on the same plane and bent at bent portions, an insulator configured to hold the multiple terminals, and an outer conductor shell configured to house the insulator. The substrate-side connector is configured such that a change in a terminal interval at each bent portion of the multiple terminals is reduced, and therefore, influence on the high-frequency characteristics (e.g., a return loss) due to impedance matching disturbance can be reduced.

18 Claims, 9 Drawing Sheets

(51) Int. Cl.
*H01R 13/40* (2006.01)
*H01R 24/64* (2011.01)
*H01R 107/00* (2006.01)

(58) Field of Classification Search
USPC ..... 439/668
See application file for complete search history.

(56) References Cited

U.S. PATENT DOCUMENTS 6,280,209 B1 * 8/2001 Bassler ..... H01R 12/724 439/101
6,464,537 B1 * 10/2002 Letourneau ..... H01R 12/714 439/108
7,445,502 B2 * 11/2008 Zhang ..... H01R 13/658 439/607.01
7,604,510 B2 * 10/2009 Akama ..... H01R 13/6585 439/637
7,674,118 B2 * 3/2010 He ..... H01R 24/60 439/108
7,682,192 B2 * 3/2010 Sawdy ..... H01R 13/514 439/607.05
8,167,631 B2 * 5/2012 Ito ..... H01R 24/38 439/108
8,398,433 B1 * 3/2013 Yang ..... H01R 31/08 439/108
8,449,322 B2 * 5/2013 Cai ..... H01R 12/724 439/541.5
8,517,774 B2 * 8/2013 Kumamoto ..... H01R 12/724 439/607.08
8,764,464 B2 * 7/2014 Buck ..... H01R 13/514 439/108
8,944,850 B2 * 2/2015 Simmel ..... H01R 43/20 439/607.55
8,944,863 B1 * 2/2015 Yang ..... H01R 13/6585 439/884
9,077,094 B2 * 7/2015 Minich ..... H01R 13/42
9,461,378 B1 * 10/2016 Chen ..... H01R 12/707
9,548,569 B2 * 1/2017 Tanaka ..... H01R 13/646
9,627,825 B2 * 4/2017 Leng ..... H01R 24/60
9,634,432 B2 * 4/2017 Su ..... H01R 13/6461
2004/0242071 A1 * 12/2004 Ito ..... H01R 13/6585 439/108
2006/0009080 A1 * 1/2006 Regnier ..... H01R 12/725 439/637
2008/0020654 A1 * 1/2008 He ..... H01R 13/658 439/855
2010/0190385 A1 * 7/2010 Yamakami ..... H01R 13/6471 439/700
2010/0240233 A1 * 9/2010 Johnescu ..... H01R 13/514 439/108
2015/0079843 A1 3/2015 Nakashima et al.
2015/0244117 A1 * 8/2015 Kawamura ..... H01R 24/60 439/676
2016/0308311 A1 * 10/2016 Hori ..... H01R 12/7005

FOREIGN PATENT DOCUMENTS

CN 201256230 Y 6/2009
EP 1311038 A2 5/2003
JP 2000286019 A 10/2000
JP 2004355819 A 12/2004
JP 2005123163 A 5/2005
JP 3150508 U 5/2009
JP 5669285 B1 2/2015
JP 2015056374 A 3/2015

OTHER PUBLICATIONS

Extended European Search Report dated Jun. 25, 2019 for the corresponding European Patent Application No. 16875294.7.
Chinese Office Action dated Apr. 22, 2019 for the corresponding Chinese Patent Application No. 201680073055.2; machine translation.

* cited by examiner (a)

(b)

(a)

(b)

(a)

(b)

CONNECTOR

TECHNICAL FIELD

The present invention relates to a connector suitable for high-speed electric signal transfer. Specifically, the present invention relates to a multi-terminal structure configured and arranged so that impedance matching can be maintained at multiple terminals included in a connector.

BACKGROUND ART

A connector used upon transfer of an electric signal and the like generally includes an insulator configured to hold multiple conductive terminals, and an outer conductor shell configured to house the insulator. For example, a connector described in JP-A-2005-123163 (Patent Literature 1) is configured such that multiple conductive terminals are housed in multiple terminal grooves of an insulator body and the insulator body is surrounded by a housing (an outer conductor shell). The multiple conductive terminals housed in the insulator body are arranged in parallel with each other in a connector fitting direction, and are bent at back end portions of the multiple conductive terminals in a direction perpendicular to the fitting direction.

CITATION LIST

Patent Literature

PATENT LITERATURE 1:JP-A-2005-123163

SUMMARY OF THE INVENTION

Problems to be Solved by the Invention

In recent years, the capacity of a data processing apparatus mounted on an electronic device such as a measurement device or an audio/video (AV) device has been improved, and therefore, an enormous quantity of data can be processed in the electronic device. Accordingly, a large quantity of data is, as an electric signal, transmitted/received at high speed via a connector. However, for such a high-frequency electric signal, the typical connector has a problem that impedance matching and the like is disturbed and desired high-frequency characteristics cannot be obtained.

For example, when the typical connector described in JP-A-2005-123163 (Patent Literature 1) transmits/receives the high-frequency electric signal, each interval between multiple conductive terminals greatly changes at the bent portion at which each of the multiple conductive terminals arranged in parallel with the connector fitting direction is bent perpendicularly to the fitting direction. This leads to a problem that impedance mismatching occurs and favorable high-frequency characteristics cannot be obtained. That is, the multiple conductive terminals are not arranged next to each other on the same plane, and the interval between portions extending in the direction of fitting the multiple conductive terminals and the interval between portions extending perpendicularly to the fitting direction are different from each other. For this reason, in the case of transferring the high-frequency electric signal, impedance mismatching occurs, and a loss (a return loss) due to reflection of the electric signal is increased. As a result, the high-frequency electric signal cannot be transmitted/received via the connector.

For solving the above-described problems, a connector is provided, the connector being a substrate-side connector including multiple terminals arranged in parallel and bent at bent portions, an insulator configured to hold the multiple terminals, and an outer conductor shell configured to house the insulator. The substrate-side connector is configured such that a change in a terminal interval at each bent portion of the multiple terminals is reduced, and therefore, influence on high-frequency characteristics (e.g., a return loss) due to impedance matching disturbance can be reduced.

Solution to the Problems

A connector according to one embodiment of the present invention is

- a connector including an outer conductor shell, a terminal group including at least one or more terminal pairs of two terminals, and an insulator housed in the outer conductor shell with the insulator holding the terminal group.

Each terminal of the terminal pair included in the terminal group includes,

- at a tip side end portion of the connector, a contact portion to be connected in contact with a terminal of a partner connector, and
- at a back end side portion of the connector, a terminal mounting portion to be mounted on a substrate.

The contact portions are arranged adjacent to each other in a direction perpendicular to the substrate.

The terminal mounting portions are arranged adjacent to each other in the horizontal direction with the directions of the terminal mounting portions being changed 90 degrees from those of the contact portions.

In a preferable embodiment of the connector according to the present invention,

- the contact portion of one terminal of the two terminals included in the terminal pair is arranged above the contact portion of the other terminal, and
- the terminal mounting portion of the one terminal is arranged inward of the connector with respect to the terminal mounting portion of the other terminal.

In a preferable embodiment of the connector according to the present invention,

- the terminal mounting portion of the one terminal has a same length as that of the terminal mounting portion of the other terminal, and
- end portions of the terminal mounting portions are arranged at positions on a straight line as viewed from the direction in which the terminal mounting portions are arranged adjacent to each other.

In a preferable embodiment of the connector according to the present invention,

- the terminal mounting portion of the one terminal is configured longer or shorter than the terminal mounting portion of the other terminal.

In a preferable embodiment of the connector according to the present invention,

- the terminal group includes two or more terminal pairs,
- the terminal mounting portion of each terminal included in one terminal pair is configured longer or shorter than the terminal mounting portion of the terminal included in the other terminal pair, and
- the terminal mounting portions of the two terminals included in each terminal pair have an identical length.

In a preferable embodiment of the connector according to the present invention, each terminal of the terminal pair includes, in this order from the contact portion to the terminal mounting portion, at least a first bent portion at which the terminal pair extending in a connector fitting direction is bent toward the substrate, and a second bent portion at which the terminal pair bent toward the substrate is bent in parallel with the substrate, and the terminals of each terminal pair are arranged in parallel along the shapes thereof.

In a preferable embodiment of the connector according to the present invention, the terminals included in the terminal pair are arranged adjacent to each other on an same plane.

In a preferable embodiment of the connector according to the present invention, each terminal included in the terminal pair is held in such a manner that part of the each terminal is covered by integral molding with the insulator.

In a preferable embodiment of the connector according to the present invention, the terminal group includes an even-number of the terminal pairs, and the half of the even-number of terminal pairs and the remaining half of the even-number of terminal pairs are arranged to face each other along a fitting direction of the connector fitting direction.

In a preferable embodiment of the connector according to the present invention, the terminal group includes four terminal pairs including eight terminals.

In a preferable embodiment of the connector according to the present invention, the terminal group includes four terminal pairs including eight terminals, and two ground terminals, and each ground terminal is arranged between adjacent ones of the terminal pairs.

In a preferable embodiment of the connector according to the present invention, each terminal of the terminal pair includes a third bent portion on a mounting portion side with respect to the second bent portion, and at the third bent portion, each terminal of the terminal pair extending outward of the connector in a direction perpendicular to the connector fitting direction after the first bent portion and the second bent portion is bent backward along the connector fitting direction.

In a preferable embodiment of the connector according to the present invention, the terminal mounting portions are exposed through a back portion of the outer conductor shell on an opposite side of a side to be fitted in the partner connector.

In a preferable embodiment of the connector according to the present invention, the terminal mounting portions are exposed through a side portion of the connector in a direction perpendicular to an outer conductor shell fitting direction.

In a preferable embodiment of the connector according to the present invention, the terminal mounting portions are DIP terminals perpendicular to the substrate such that mounting of the terminal mounting portions is allowed with the terminal mounting portions being inserted into holes provided at the substrate.

In a preferable embodiment of the connector according to the present invention, the terminal mounting portions have a shape bent in a single-step shape such that surface-mounting of the terminal mounting portions on the substrate is allowed.

A connector manufacturing method for manufacturing the connector according to one embodiment of the present invention includes at least the step of cutting out the terminal pair with the first bent portions from a metal plate, and the step of perpendicularly bending back end side portions of the cutout terminal pair with respect to the first bent portions to form the second bent portions.

A connector manufacturing method for manufacturing the connector according another embodiment of the present invention includes at least the step of cutting out the terminal pair from a metal plate such that the first bent portions and the third bent portions are formed on an identical plane, and the step of perpendicularly bending a portion between each first bent portion and each second bent portion in each cutout terminal pair to form the second bent portion between the first bent portion and the third bent portion.

Advantageous Effects of the Invention

In the connector according to the present invention, the multiple terminals forming one or more terminal pairs held by the insulator in the outer conductor shell are arranged in parallel with and adjacent to each other on the same plane. Such arrangement is maintained even in a case where these multiple terminals are bent at one or more bent portions. Thus, a change in the interval between adjacent ones of the multiple terminals can be reduced, and lowering of high-frequency characteristics due to impedance matching disturbance can be suppressed.

Moreover, in the connector manufacturing method for manufacturing the connector according to the present invention, the multiple terminals forming one or more terminal pairs held by the insulator in the outer conductor shell are cut out and formed from the metal plate such that the multiple terminals are arranged in parallel with and adjacent to each other. Thus, the multiple terminals can be arranged on the same plane, and one or more bent portions including at least the first bent portions can be easily provided on the same plane. Further, the multiple terminals are collectively and perpendicularly bent at the back end side portions with respect to the first bent portions, and therefore, a state in which the multiple terminals are arranged on the same plane can be maintained while the second bent portions are easily formed. Thus, the change in the interval between the multiple terminals can be reduced, and lowering of the high-frequency characteristics due to impedance matching disturbance can be suppressed.

DESCRIPTION OF THE EMBODIMENTS

Figure 1:
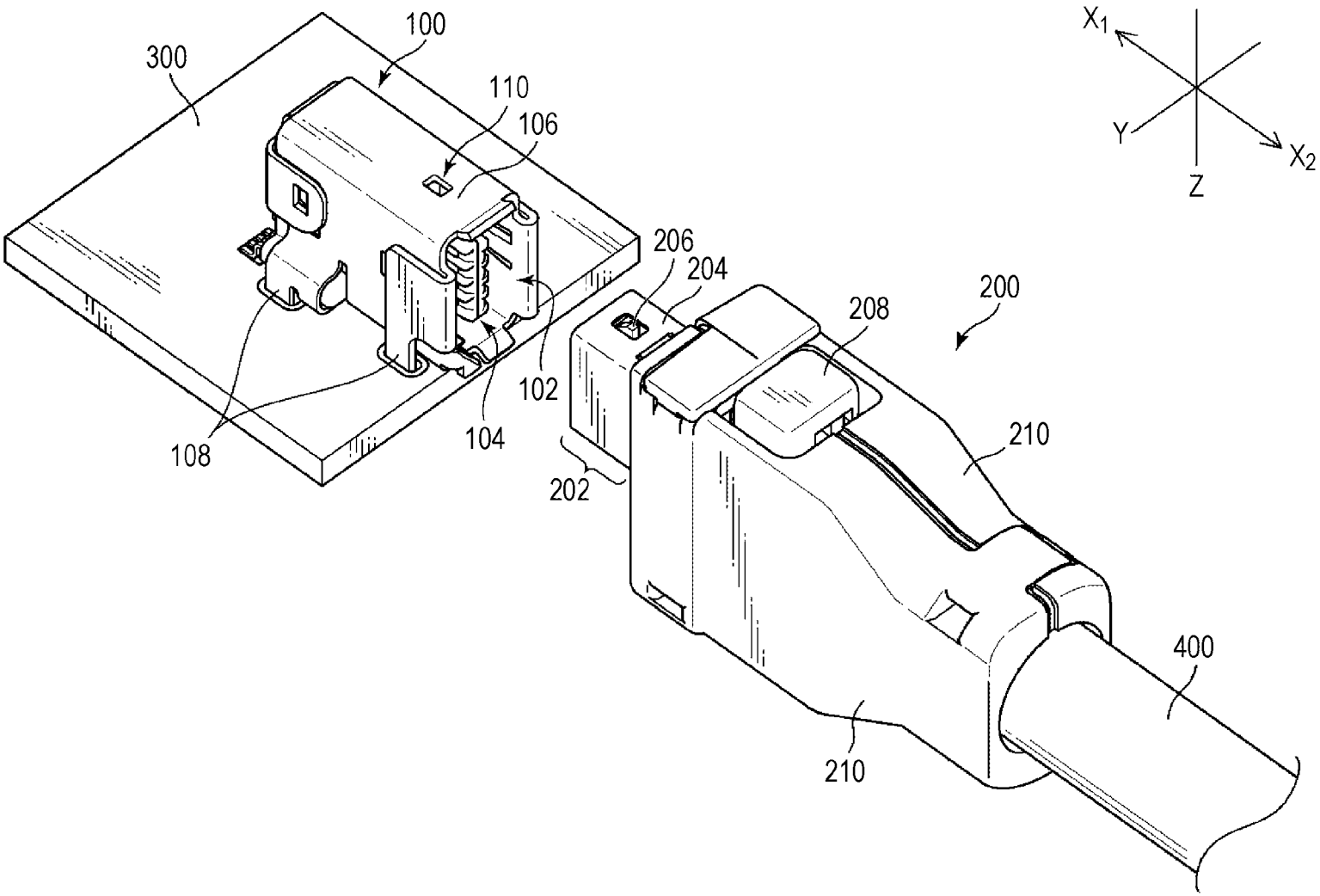
FIG. 1 illustrates a view of outer appearances of a substrate-side connector and a cable-side connector.

Hereinafter, embodiments of the present invention will be described with reference to the drawings. Note that in all figures for describing the embodiments, the same reference numerals are, as a general rule, used to represent the same members, and therefore, repeated description thereof will not be made. Moreover, each embodiment will be independently described, but it does not intended to exclude a combination of components of these embodiments forming a connector.

FIG. 1 illustrates a view of outer appearances of a substrate-side connector and a cable-side connector. A connector fitting direction is an X1-X2 direction (an X-axis direction) in the figure. A tip end side of the substrate-side connector 100 is an X2 direction side, and a tip end side of the cable-side connector 200 is an X1 direction side. A plane perpendicular to a substrate 300 is an X-Z plane, and a plane horizontal (a plane parallel) to the substrate 300 is an X-Y plane. Upper and lower sides along a Z-axis direction in the figure are upper and lower sides of each connector. The same also applies to other figures.

The substrate-side connector 100 includes an insulator 112 (see FIG. 2) configured to hold multiple terminals and forming a fitting raised portion 104 on a side (the X2 direction side) to be connected to the cable-side connector 200, and an outer conductor shell 106 having the insulator 112 therein. A fitting recessed portion 102 is a space between the fitting raised portion 104 provided on a fitting side (the X2 side) of the outer conductor shell 106 and an inner wall of the outer conductor shell 106. The outer conductor shell 106 includes shell mounting portions 108 for mounting and fixing the outer conductor shell 106 onto the substrate 300. The shell mounting portions 108 are DIP terminals to be soldered with the DIP terminals being inserted into holes provided at the substrate 300, but may be terminals mountable on a substrate surface.

Moreover, the outer conductor shell 106 includes lock holes 110 to be engaged with lock protrusions 206 of the cable-side connector 200. The lock holes 110 are provided at such positions that the lock holes 110 can engage with the lock protrusions 206 of the cable-side connector 200. In FIG. 1, the lock holes 110 are provided at upper and lower (the upper and lower sides in the Z-axis direction) side walls of the outer conductor shell 106 of the connector 100. As long as the structure is made such that the lock holes 110 can engage with the lock protrusions 206, the lock holes 110 are not necessarily holes penetrating the outer conductor shell. In another embodiment, lock protrusions may be provided at an outer conductor shell of a substrate-side connector, and lock holes may be provided at an outer conductor shell of a cable-side connector.

The cable-side connector 200 includes an outer conductor shell 204 having a fitting portion 202 on a side (the X1 direction side) to be connected to the substrate-side connector 100, i.e., on the tip end side, and housing an insulator holding multiple terminal therein, a lock operation button 208 cooperating with the lock protrusions 206 protruding from holes of the outer conductor shell 204, and a cover member 210 covering a connection portion between the outer conductor shell 204 and a cable 400.

The fitting portion 202 is inserted into the fitting recessed portion 102 upon connection with the substrate-side connector 100. The outer conductor shell 204 has, at side walls thereof, the holes allowing the lock protrusions 206 to protrude from the inside. The lock protrusions 206 are provided at such positions that the lock protrusions 206 can engage with the lock holes 110 of the substrate-side connector 100. In FIG. 1, the lock protrusions 206 are provided at the upper and lower (the upper and lower sides in the Z-axis direction) side walls of the outer conductor shell 204 of the connector 200. For the lock protrusions 206, any structure may be employed as long as engagement with the lock holes 110 is possible.

The lock protrusions 206 are, in the outer conductor shell 204, coupled to the lock operation button 208, and are pushed in association with pushing in of the lock operation button 208. The lock operation button 208 is pushed in upon connection with the substrate-side connector 100 such that the lock protrusions 206 disengage from the lock holes 110, and the cable-side connector 200 can be pulled out of the substrate-side connector 100.

Figure 2:
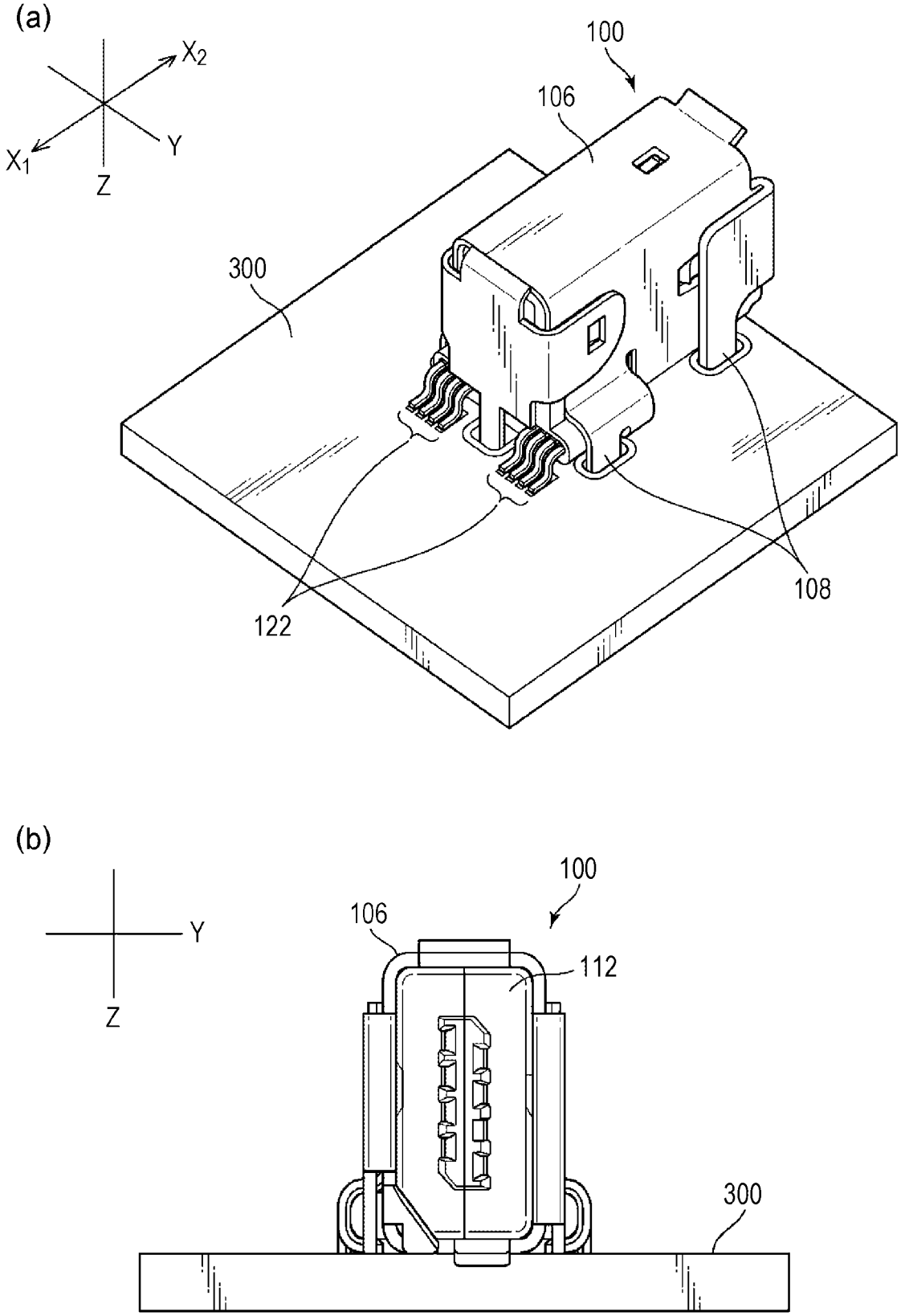
FIG. 2 illustrates views of the outer appearance of the substrate-side connector according to one embodiment of the present invention.

FIG. 2 illustrates views of the outer appearance of the substrate-side connector according to one embodiment of the present invention. FIG. 2(*a*) is a perspective view of the connector 100 viewed diagonally from a back side (the X1 side), and FIG. 2(*b*) is a front view of the connector 100 viewed from a front side (the X2 side). The insulator 112 holds the multiple terminals, forms the fitting raised portion 104, and is housed in the outer conductor shell 106. The insulator 112 can be integrally molded with the multiple terminals to cover at least part of the multiple terminals. The multiple terminals are exposed through the insulator 112 on the back side (the X1 side) of the outer conductor shell 106, and are soldered and fixed onto the surface of the substrate 300 by terminal mounting portions 122 provided at each exposed terminal. The terminal mounting portions 122 are surface-mounted on the substrate 300, but may be configured as DIP terminals so that the DIP terminals are inserted into holes provided at the substrate for mounting.

Figure 3:
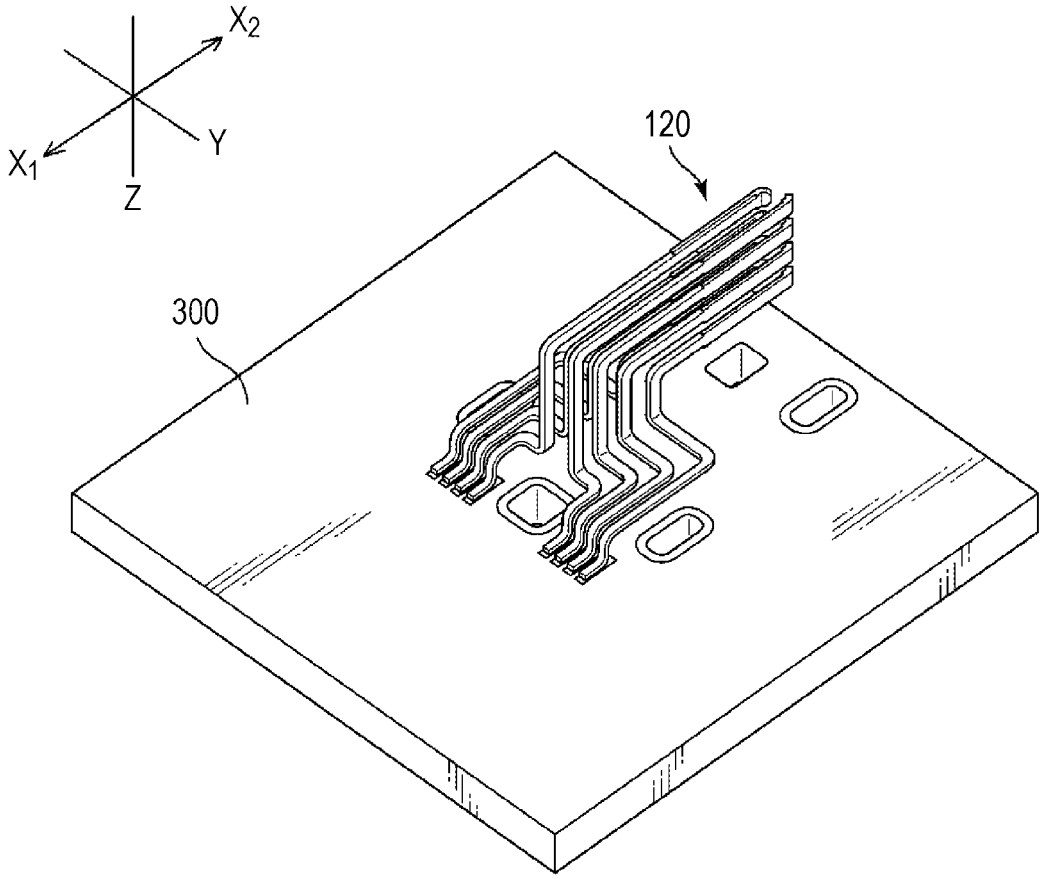
FIG. 3 illustrates views of only a state of terminals, excluding an outer conductor shell and an insulator of the connector illustrated in FIG. 2.
Figure 3:
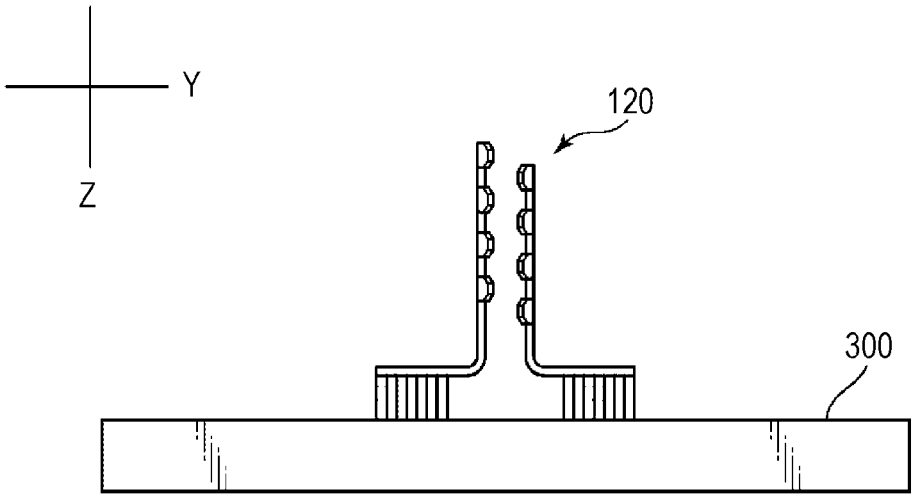

FIG. 3 illustrates only a state of the terminals, excluding the outer conductor shell and insulator of the connector according to one embodiment of the present invention illustrated in FIG. 2. FIG. 3(*a*) is a perspective view of a terminal group 120 viewed diagonally from the back side (the X1 side), and FIG. 3(*b*) is a front view of the connector 100 viewed from the front side (the X1 side). The terminal group 120 includes four terminal pairs of two terminals. Moreover, in the terminal group 120, the half of the four terminal pairs, i.e., two terminal pairs, and the remaining two terminal pairs are arranged to face each other along the fitting direction.

In the embodiment illustrated in FIG. 3, the terminal group 120 includes four terminal pairs, i.e., eight terminals, but may include at least one or more terminal pairs. In the case of including an even-number of terminal pairs, the half of the even-number of terminal pairs and the remaining half of the terminal pairs can be arranged to face each other along the connector fitting direction (the X1-X2 direction).

Figure 4:
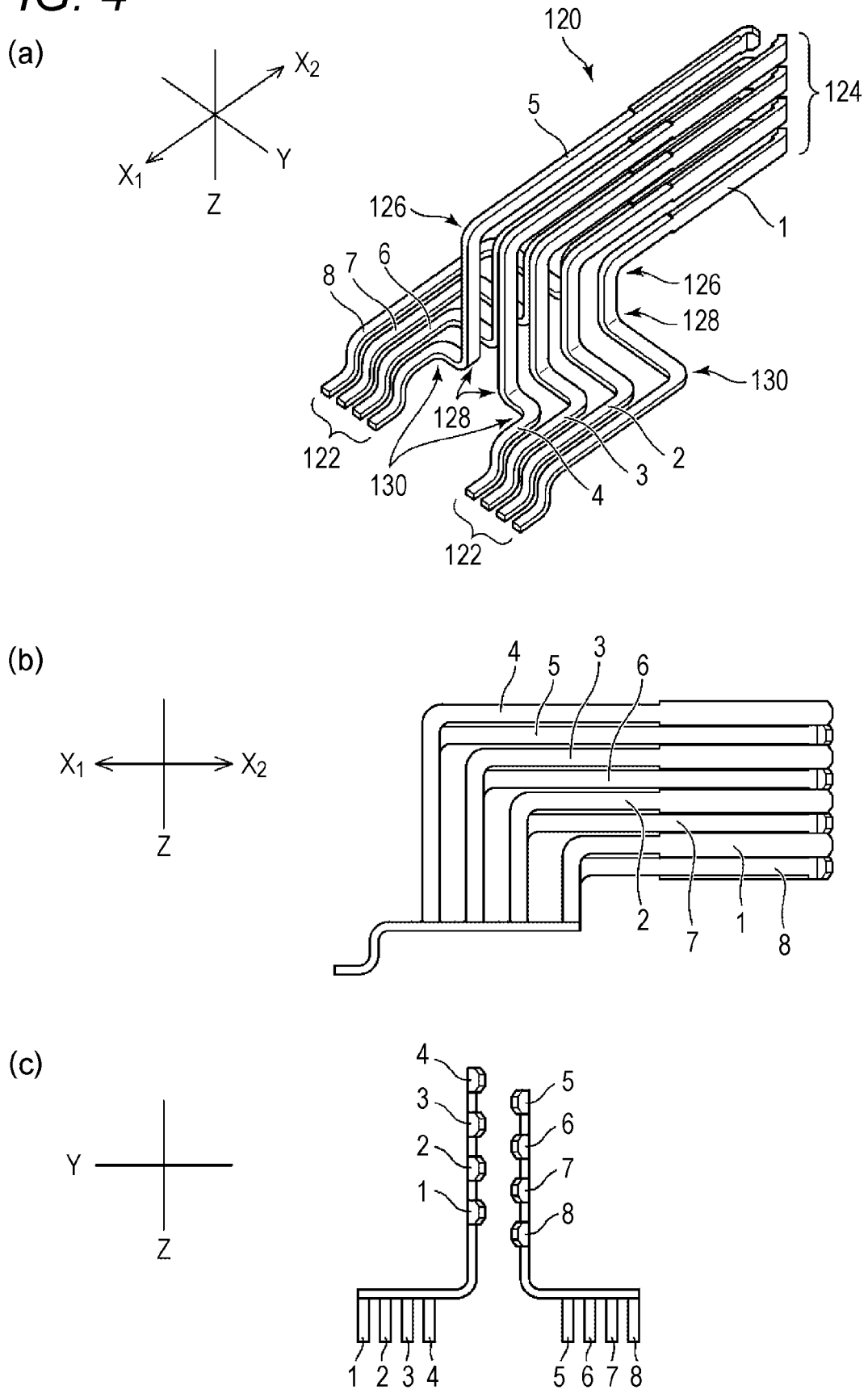
FIG. 4 illustrates views of the terminals to be used for the connector according to one embodiment of the present invention.

FIG. 4 illustrates only the terminals to be used for the connector according to one embodiment of the present invention, excluding the substrate from FIG. 3. FIG. 4(*a*) is a perspective view of the terminal group 120 viewed diagonally from the back side (the X1 side), FIG. 4(*b*) is a side view of the terminal group 120 viewed from a lateral direction (a Y-axis direction), and FIG. 4(*c*) is a front view of the terminal group 120 viewed from the front side (the X2 side). The terminal group 120 includes the terminal mounting portions 122 at a back end side portion (the X1 side), and contact portions 124 at a tip end portion (the X2 side). The terminal group 120 includes eight terminals of terminals 1 to 8, and two terminals form a single terminal pair. In the embodiment illustrated in FIG. 4, the terminal 1 and the terminal 2 form a terminal pair, the terminal 3 and the terminal 4 form a terminal pair, the terminal 5 and the terminal 6 form a terminal pair, and the terminal 7 and the terminal 8 form a terminal pair. Each terminal of the terminal pair can be arranged in parallel along the shapes thereof, and can be arranged adjacent to each other on the same plane (e.g., the X-Z plane, the X-Y plane).

Each terminal mounting portion 122 is formed in such a manner that a back end side portion of a corresponding one of the terminals 1 to 8 is bent downward in the perpendicular direction (the Z-axis direction) and a back end side portion with respect to such a bent portion is further bent horizontal (parallel) to the substrate toward the back side (the X1 side). That is, the terminal mounting portion 122 has a shape bent in a single-step shape, and therefore, can be surface-mounted on the substrate 300. The terminal mounting portions 122 are arranged adjacent to each other in the horizontal direction (the Y-axis direction), and end portions of the terminal mounting portions 122 are arranged at positions on a straight line as viewed from the direction (the Y-axis direction) in which the terminal mounting portions 122 are arranged adjacent to each other. Moreover, the terminal mounting portions 122 can be DIP terminals fixable by soldering with the DIP terminals being inserted into holes of the substrate.

The contact portions 124 are each formed at tip end portions of the terminals 1 to 8, and are formed wider than other portions of the terminal portions. The contact portions 124 have, at tip end portions thereof, a shape bent inward of the connector for facilitating contact with terminals of a partner connector (e.g., the cable-side connector 200 illustrated in FIG. 1). The contact portions 124 of the terminals 1 to 4 are arranged adjacent to each other in the perpendicular direction (the Z-axis direction), and the contact portions 124 of the terminal 5 to 8 are also similarly arranged adjacent to each other in the perpendicular direction (the Z-axis direction). That is, the contact portions 124 of the terminals 1 to 4 and the contact portions 124 of the terminals 5 to 8 extend in the connector fitting direction (the X-axis (X1-X2) direction), and are arranged next to each other in the perpendicular direction (the Z-axis direction).

As illustrated in FIGS. 4(*b*) and (*c*), in the plane (the X-Z plane) perpendicular to the substrate, the terminal 1 is arranged to face a portion between the terminal 7 and the terminal 8, the terminal 2 is arranged to face a portion between the terminal 6 and the terminal 7, and the terminal 3 is arranged to face a portion between the terminal 5 and the terminal 6. Moreover, the terminal 5 is arranged to face a portion between the terminal 3 and the terminal 4, the terminal 6 is arranged to face a portion between the terminal 2 and the terminal 3, and the terminal 7 is arranged to face a portion between the terminal 1 and the terminal 2. The terminals 1 to 8 are, along the shapes thereof, constantly held by the insulator 112 at regular intervals.

Figure 7:
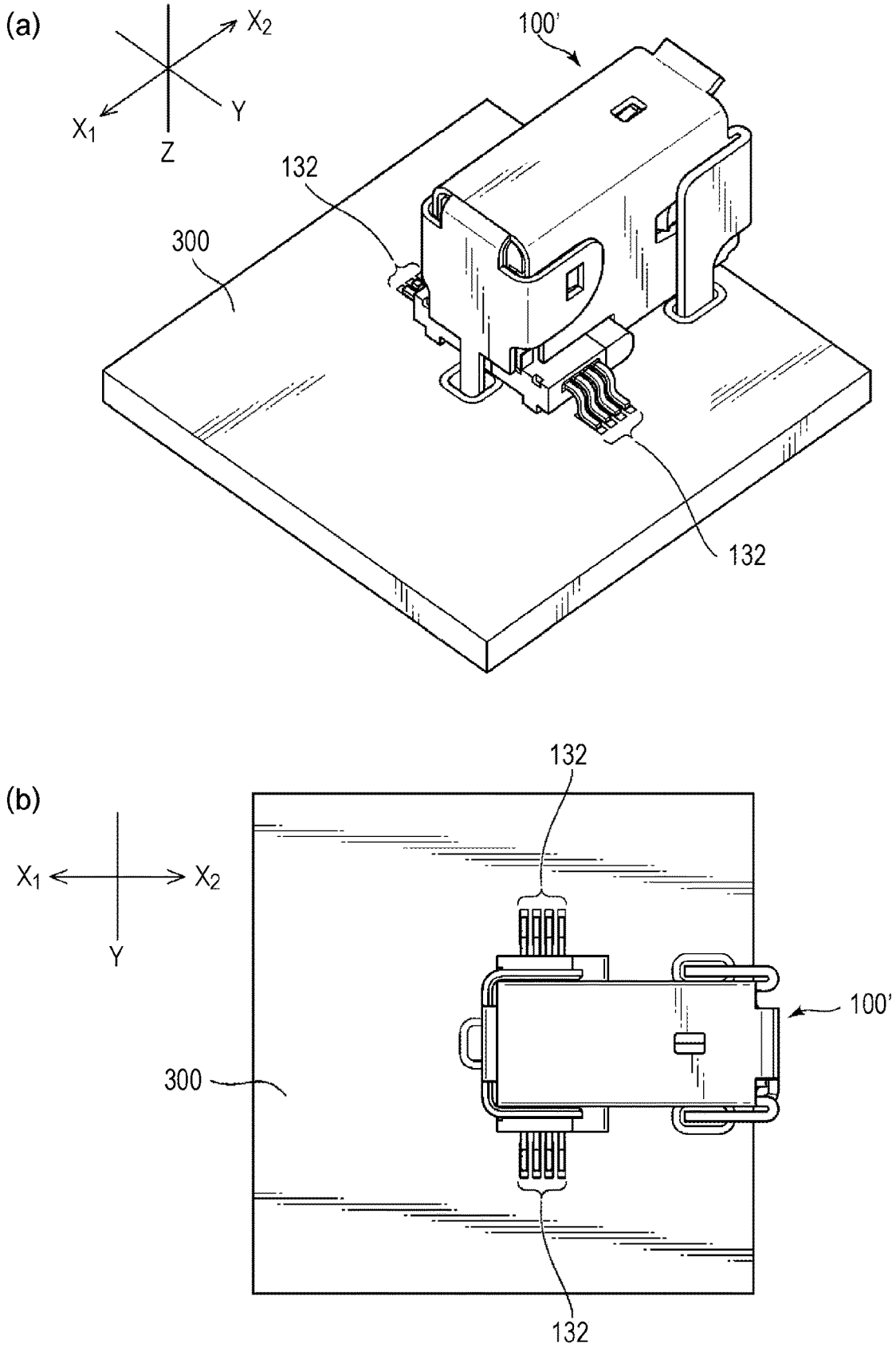
FIG. 7 illustrates views of an outer appearance of a connector according to another embodiment of the present invention.

Moreover, the terminal group 120 includes, in this order from the tip end to the back end, a bent portion 126 at which the terminal pairs extending backward (the X2 side) along the connector fitting direction are bent in the direction of the substrate (downward in the Z-axis), a bent portion 128 at which the terminal pairs extending in the direction of the substrate are bent outward of the connector in the direction (the Y-axis direction) perpendicular to the connector fitting direction, and a bent portion 130 at which the terminal pairs extending in an axis-perpendicular direction are bent backward (the X1 side) along the connector fitting direction. The terminal group 120 may include at least the bent portion 126 and the bent portion 128, and the bent portion 130 may not necessarily be provided. Another embodiment in which no bent portion 130 is provided is illustrated in FIG. 7, and will be described in detail later.

The terminal mounting portions 122 are arranged adjacent to each other in the horizontal direction (the Y-axis direction) with the directions of the terminal mounting portions 122 being changed 90 degrees from those of the contact portions 124 arranged next to each other in the perpendicular direction (the Z-axis direction). That is, at each terminal, the plane of the terminal mounting portion 122 in the horizontal direction, is bent at the bent portion 126 and the bent portion 128 to change the direction of the terminal mounting portion 122 by 90 degrees, and then, continues to the plane of the contact portion 124 in the perpendicular direction.

As illustrated in FIG. 4, the multiple terminals forming one or more terminal pairs held by the insulator 112 in the outer conductor shell 106 are arranged in parallel with and adjacent to each other on the same plane (e.g., the X-Z plane, the X-Y plane), and such arrangement at the regular intervals is maintained even in a case where the multiple terminals are bent at the bent portion 126, the bent portion 128, and the bent portion 130. Thus, a change in the interval between the multiple terminals can be reduced, and lowering of high-frequency characteristics due to, e.g., impedance matching disturbance can be suppressed.

Figure 5:
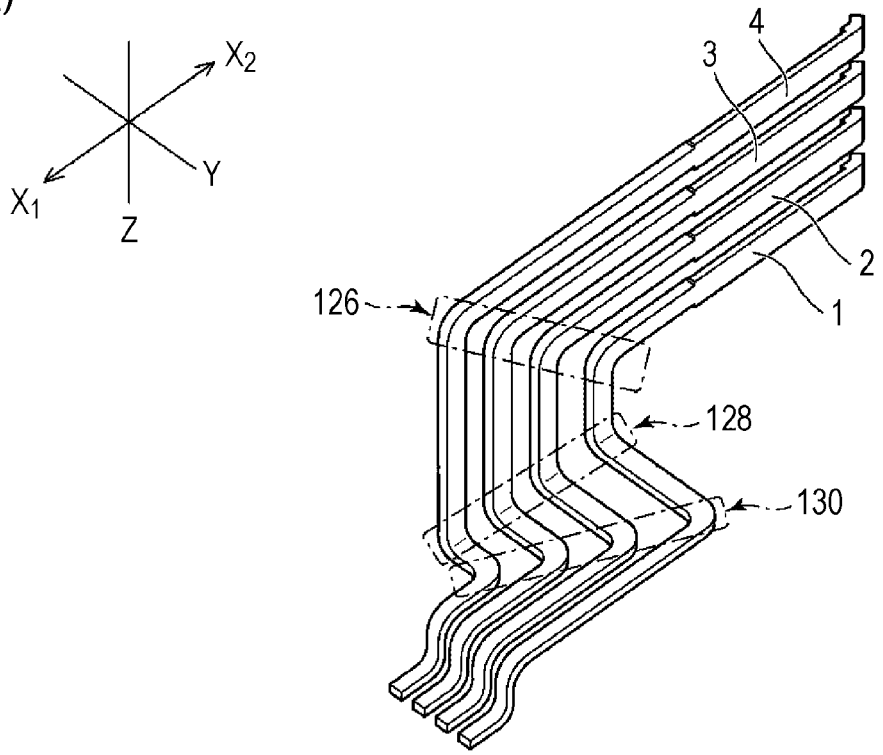
FIG. 5 illustrates views of one terminal group of terminal groups of FIG. 4.
Figure 5:
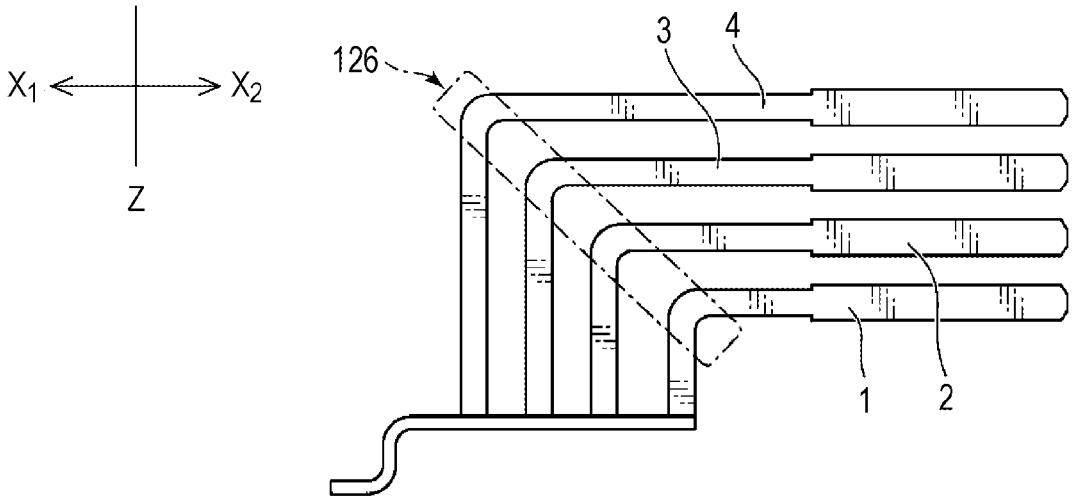

FIG. 5 illustrates one terminal group of the terminal groups arranged to face each other in FIG. 4. FIG. 5(*a*) is a perspective view of the terminal group 120 including two terminal pair (the terminal pair of the terminal 1 and the terminal 2 and the terminal pair of the terminal 3 and the terminal 4) viewed diagonally from the back side (the X1 side), and FIG. 5(*b*) is a side view of the terminal group 120 viewed from the lateral direction (the Y-axis direction). The minimum configuration of the terminal group 120 may include at least a single terminal pair, and a single terminal pair forms the minimum configuration of the terminal group 120.

The bent portion 126 is such a portion that the terminals 1 to 4 arranged adjacent to each other in the perpendicular direction and extending backward (the X1 side) from the tip end side (the X2 side) at the regular intervals are bent toward the substrate in the perpendicular direction (downward in the Z-axis). The bent portion 126 for each of the terminals 1 to 4 is configured such that the terminal interval is held constant, and is provided at each terminal such that the bent portions 126 are arranged next to each other diagonally (e.g., diagonally at 45 degrees) on the perpendicular plane (the X-Z plane).

The bent portion 128 is such a portion that the terminals 1 to 4 bent downward (downward in the Z-axis) at the bent portions 126 are bent outward in the axis-perpendicular direction (the Y-axis direction) with respect to the fitting direction (the X-axis). The bent portion 128 for each of the terminals 1 to 4 is configured such that the terminal interval is held constant, and is provided at each terminal such that the bent portions 128 are arranged next to each other on a straight line of the fitting direction (the X-axis direction) on the horizontal plane (the X-Y plane).

The bent portion 130 is such a portion that the terminals 1 to 4 bent outward in the axis-perpendicular direction (the Y-axis direction) at the bent portions 128 are bend backward (the X1 side). The bent portion 130 for each of the terminals 1 to 4 is configured such that the terminal interval is held constant, and is provided at each terminal such that the bent portions 130 are arranged next to each other diagonally to the fitting direction (the X-axis direction) on the horizontal plane (the X-Y plane). In another embodiment, the bent portion 130 is not necessarily provided at the terminal group 120. The same configuration of the bent portion 126, the bent portion 128, and the bent portion 130 as described above also applies to the terminals 5 to 8 on the other side.

Figure 6:
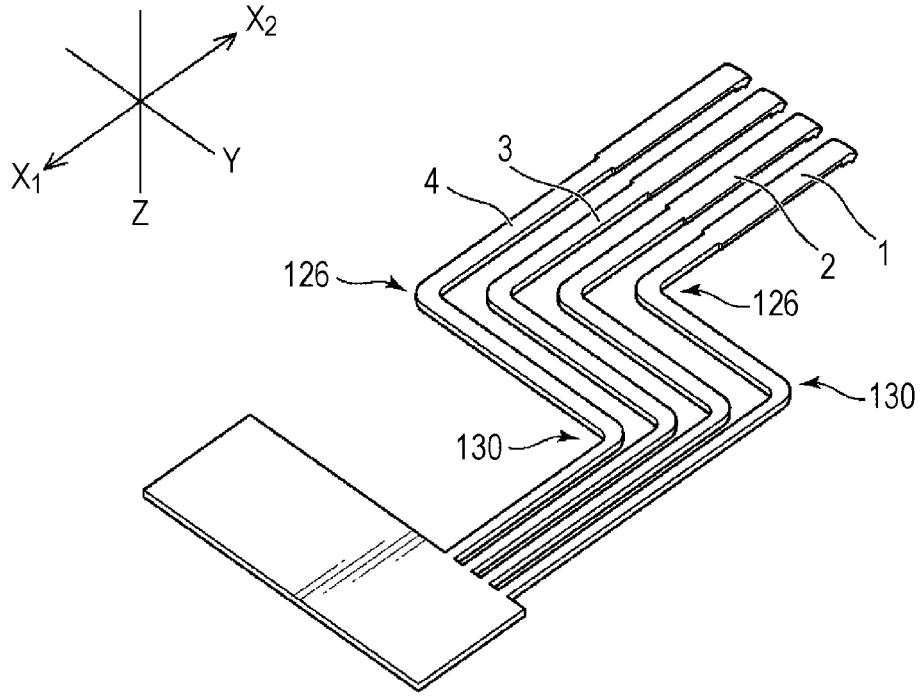
FIG. 6 illustrates views of some of the steps of forming terminal pair including multiple terminals from a metal plate.
Figure 6:
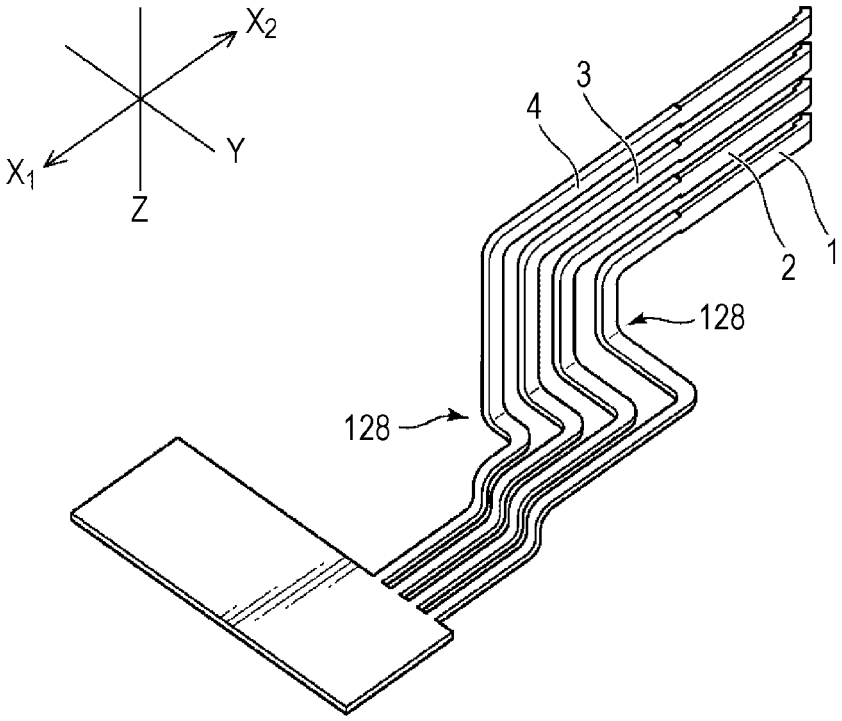

FIG. 6 illustrates some of the steps of forming the terminal pair including the multiple terminals from a metal plate of, e.g., copper or stainless steel. FIG. 6(*a*) illustrates a state when the terminal group including the terminal pair of the terminal 1 and the terminal 2, and the terminal pair having the terminal 3 and the terminal 4 is cut out from the metal plate and remains connected to a carrier. Upon cutting out from the metal plate, the bent portion 126 and bent portion 130 of each terminal are formed adjacent to each other diagonally to the X-axis on the horizontal plane (the X-Y plane). No bent portion 128 bent in the perpendicular direction (the Z-axis direction) is formed, and therefore, each terminal is on the same plane.

In FIG. 6(*b*), the terminal group on the same plane as illustrated in FIG. 6(*a*) is, at the bent portions 128, collectively and perpendicularly bent to form the terminal group 120 used for the substrate-side connector 100. The bent portion 128 is formed in such a manner that a portion between the bent portion 126 and the bent portion 130 is bent perpendicularly (upward in the Z-axis direction) on the straight line along the fitting direction (the X-axis direction).

Moreover, in another embodiment in which no bent portion 130 is provided, the bent portions 128 are formed in such a manner that back end side portions with respect to the bent portions 126 are collectively and perpendicularly (upward in the Z-axis direction) bent. Then, back end side portions of the terminals 1 to 4 are bent downward in the perpendicular direction (the Z-axis direction), and back end side portions with respect to such bent portions are further bent horizontal (parallel) to the substrate toward the back side (the X1 side). That is, the terminal mounting portions 122 bent in a single-step shape are formed at the back end portion of the terminal group.

By the steps illustrated in FIG. 6(*a*) to (*b*), the multiple terminals forming one or more terminal pairs held by the insulator 112 in the outer conductor shell 106 are cut out and formed from the metal plate with the multiple terminal being arranged in parallel with and adjacent to each other. In this manner, one or more bent portions including at least the bent portions 126 can be easily provided on the same plane with the multiple terminals being arranged on the same plane. Further, the multiple terminals are collectively and perpendicularly bent at the back end side portions with respect to the bent portions 126 (in the embodiment in which the bent portions 130 are provided, at each portion between the bent portion 126 and the bent portion 130), and therefore, the bent portions 128 can be easily formed while a state in which the multiple terminals are arranged on the same plane can be maintained. With this configuration, the change in the interval between the multiple terminals can be reduced, and lowering of the high-frequency characteristics due to impedance matching disturbance can be suppressed.

FIG. 7 illustrates views of an outer appearance of a connector according to another embodiment of the present invention. FIG. 7(*a*) is a perspective view of the connector 100' viewed diagonally from the back side (the X1 side), and FIG. 7(*b*) is a front view of the connector 100' viewed from the front side (the X2 side). Terminal mounting portions 132 are exposed through side portions of the connector 100' on the back side (the X1 side), and are surface-mounted on a substrate 300 in a single-step shape. No bent portions 130 are provided at a terminal group inside the connector 100', and therefore, the terminal mounting portions 132 can extent outward of the connector in the direction (the Y-axis direction) perpendicular to the direction (the X-axis direction) of fitting the connector 100'. The terminal mounting portions 132 are arranged adjacent to each other in the fitting direction (the X-axis direction), and end portions of the terminal mounting portions 132 are arranged at positions on a straight line as viewed from the direction (the X-axis direction) in which the terminal mounting portions 132 are arranged adjacent to each other.

In the embodiment illustrated in FIG. 7, the multiple terminals in the connector 100' can be, as in the embodiments illustrated in FIGS. 2 to 5, arranged in parallel along the shapes thereof, and can be arranged adjacent to each other on the same plane (e.g., the X-Z plane, the X-Y plane). That is, each terminal can be held by an insulator housed in an outer conductor shell with the terminals being held at regular intervals. With this configuration, a change in the interval between the multiple terminals can be reduced as in the embodiments illustrated in FIGS. 2 to 5, and lowering of high-frequency characteristics due to, e.g., impedance matching disturbance can be suppressed.

Figure 8:
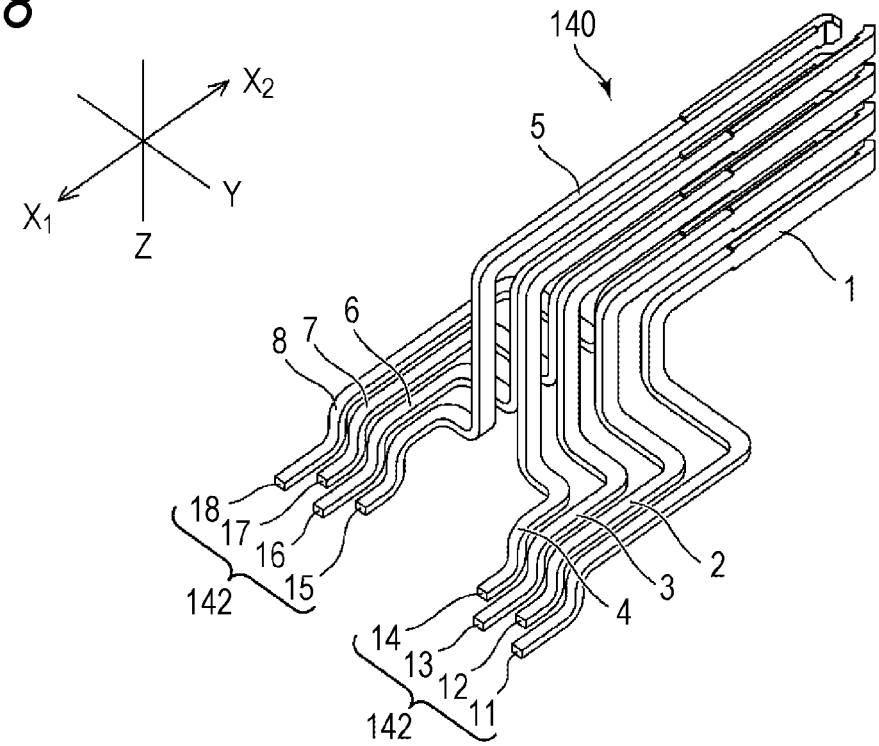
FIG. 8 illustrates a view of another embodiment of the terminal group included in the connector according to the present invention.

FIG. 8 illustrates a view of a variation of the terminal group included in the connector according to the present invention. A basic configuration of a terminal group 140 is similar to that of the terminal group 120 illustrated in FIG. 4. The terminal group 140 includes eight terminals of terminals 1 to 8, and two terminals form a single terminal pair. In the embodiment illustrated in FIG. 8, the terminal 1 and the terminal 2 form a terminal pair, the terminal 3 and the terminal 4 form a terminal pair, the terminal 5 and the terminal 6 form a terminal pair, and the terminal 7 and the terminal 8 form a terminal pair. Each terminal of terminal pair can be arranged in parallel along the shapes thereof, and can be arranged adjacent to each other on the same plane (e.g., the X-Z plane, the X-Y plane).

In the terminals 1 to 8 included in the terminal group 140, terminal mounting portions 142 as portions to be mounted on a substrate will be each referred to as "terminal mounting portions 11 to 18" for identifying these portions for each terminal. The terminal mounting portion 142 of the terminal group 140 is configured as follows: the configuration of the terminal mounting portion 122 of the terminal group 120 illustrated in FIG. 4 is changed such that the length of the portion (i.e., the terminal mounting portion) to be mounted on the substrate at one of the terminals of the terminal pair is different from that of the other terminal.

As illustrated in FIG. 8, in the terminal pair of the terminal 1 and the terminal 2, the terminal mounting portion 11 of the terminal 1 can be configured longer than the terminal mounting portion 12 of the terminal 2. Similarly, in the terminal pair of the terminal 3 and the terminal 4, the terminal mounting portion 13 of the terminal 3 can be configured longer than the terminal mounting portion 14 of the terminal 4. In the terminal pair of the terminal 5 and the terminal 6, the terminal mounting portion 16 of the terminal 6 can be configured longer than the terminal mounting portion 15 of the terminal 5. In the terminal pair of the terminal 7 and the terminal 8, the terminal mounting portion 18 of the terminal 8 can be configured longer than the terminal mounting portion 17 of the terminal 7. Conversely, the terminal mounting portions 12, 14, 16, 18 of the terminals 2, 4, 6, 8 can be configured longer than the terminal mounting portions 11, 13, 15, 17 of the terminals 1, 3, 5, 7. That is, the length of the terminal mounting portion of one terminal included in the terminal pair can be configured longer or shorter than that of the other terminal.

The terminal mounting portions 11, 13, 15, 17 can be configured with the same length, and therefore, end portions of the terminal mounting portions 11, 13, 15, 17 are arranged at positions on a straight line when the terminal group 140 is viewed from the lateral direction (the Y-axis direction). Similarly, the terminal mounting portions 12, 14, 16, 18 can be configured with the same length, and therefore, end portions of the terminal mounting portions 12, 14, 16, 18 are also arranged at positions on a straight line when the terminal group 140 is viewed from the lateral direction (the Y-axis direction).

For example, in other variations, the terminal mounting portions 11, 14, 15, 18 of the terminals 1, 4, 5, 8 may be configured longer than the terminal mounting portions 12, 13, 16, 17 of the terminals 2, 3, 6, 7. Conversely, the terminal mounting portions 12, 13, 16, 17 of the terminals 2, 3, 6, 7 may be configured longer than the terminal mounting portions 11, 14, 15, 18 of the terminals 1, 4, 5, 8. In this variation, the terminal mounting portions 11, 14, 15, 18 can be configured with the same length, and similarly, the terminal mounting portions 12, 13, 16, 17 can be configured with the same length. The terminal group 140 is configured as in the variation illustrated in FIG. 8 or the other variations described above so that lowering of the high-frequency characteristics due to impedance matching disturbance can be suppressed.

Figure 9:
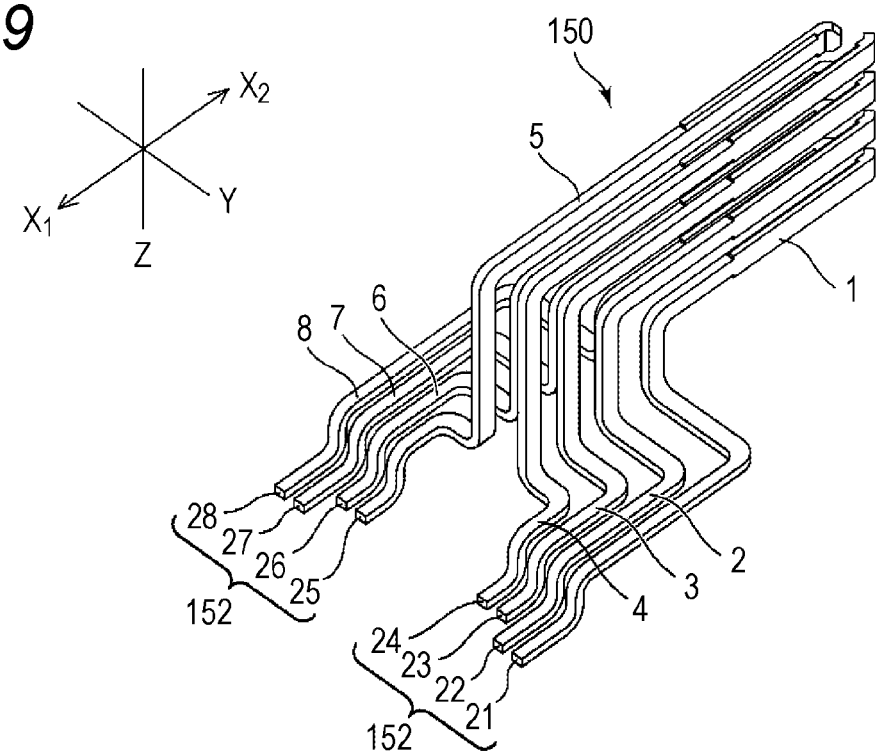
FIG. 9 illustrates a view of still another embodiment of the terminal group included in the connector according to the present invention.

FIG. 9 illustrates a view of another variation of the terminal group included in the connector according to the present invention. A basic configuration of a terminal group 150 is similar to that of the terminal group 120 illustrated in FIG. 4. The terminal group 150 includes eight terminals of terminals 1 to 8, and two terminals form a single terminal pair. In the embodiment illustrated in FIG. 9, the terminal 1 and the terminal 2 form a terminal pair, the terminal 3 and the terminal 4 form a terminal pair, the terminal 5 and the terminal 6 form a terminal pair, and the terminal 7 and the terminal 8 form a terminal pair. Each terminal of the terminal pair can be arranged in parallel along the shapes thereof, and can be arranged adjacent to each other on the same plane (e.g., the X-Z plane, the X-Y plane).

In the terminals 1 to 8 included in the terminal group 150, terminal mounting portions 152 as portions to be mounted on a substrate will be each referred to as "terminal mounting portions 21 to 28" for identifying these portions for each terminal. The terminal mounting portion 152 of the terminal group 150 is configured as follows: the configuration of the terminal mounting portion 122 of the terminal group 120 illustrated in FIG. 4 is changed such that the length of the terminal mounting portion at each terminal of one of two adjacent terminal pairs is different from each terminal of the other terminal pair. In this variation, the terminal mounting portions of the two terminals included in the terminal pair have the same length. As illustrated in FIG. 9, the terminal mounting portion 21 and the terminal mounting portion 22 in the terminal pair of the terminal 1 and the terminal 2 can be configured longer than the terminal mounting portion 23 and the terminal mounting portion 24 in the terminal pair of the terminal 3 and the terminal 4. Similarly, the terminal mounting portion 27 and the terminal mounting portion 28 in the terminal pair of the terminal 7 and the terminal 8 can be configured longer than the terminal mounting portion 25 and the terminal mounting portion 25 in the terminal pair of the terminal 5 and the terminal 6. Conversely, the terminal mounting portions 23, 24, 25, 26 of the terminals 3, 4, 5, 6 can be configured longer than the terminal mounting portions 21, 22, 27, 28 of the terminals 1, 2, 7, 8. That is, the length of the terminal mounting portion of each terminal included in one terminal pair can be configured longer or shorter the length of the terminal mounting portion of each terminal included in the other terminal pair. Moreover, the terminal mounting portions of the two terminals included in the terminal pair can have the equal length.

The terminal mounting portions 21, 22, 27, 28 can be configured with the same length, and therefore, end portions of the terminal mounting portions 21, 22, 27, 28 are arranged at positions on a straight line when the terminal group 150 is viewed from the lateral direction (the Y-axis direction). Similarly, the terminal mounting portions 23, 24, 25, 26 can be configured with the same length, and therefore, end portions of the terminal mounting portions 23, 24, 25, 26 are also arranged at positions on a straight line when the terminal group 150 is viewed from the lateral direction (the Y-axis direction). The terminal group 150 is configured as in the variation illustrated in FIG. 9 or the other variations described above so that the change in the terminal interval in the terminal pair can be reduced and lowering of the high-frequency characteristics due to impedance matching disturbance can be suppressed.

Figure 10:
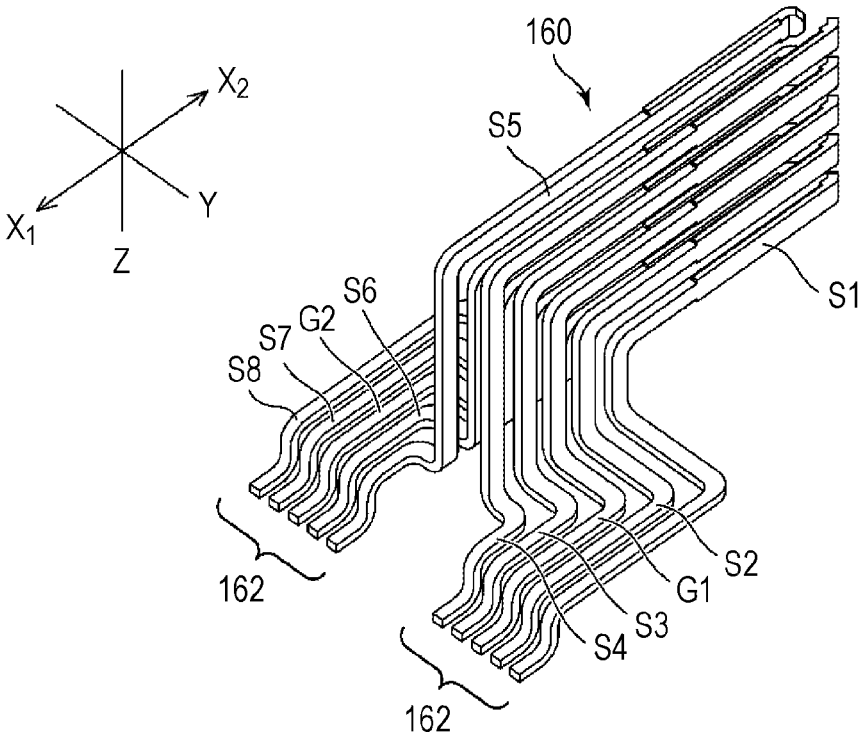
FIG. 10 illustrates a view of an embodiment in which each of ground terminals is added to between the terminal pairs of the terminal group included in the connector according to the present invention.

FIG. 10 illustrates a view of still another variation of the terminal group included in the connector according to the present invention. A basic configuration of a terminal group 160 is similar to that of the terminal group 120 illustrated in FIG. 4. The terminal group 160 includes ten terminals including terminals S1 to S8 as signal terminals and ground terminals G1, G2. Each terminal of terminal pairs and the ground terminals can be arranged in parallel along the shapes thereof, and can be arranged adjacent to each other on the same plane (e.g., the X-Z plane, the X-Y plane). With this configuration, the interval between the multiple terminals can be held constant, i.e., the change in the interval can be reduced. Thus, lowering of the high-frequency characteristics due to, e.g., impedance matching disturbance can be suppressed.

Moreover, each of the ground terminals G1, G2 is arranged between adjacent ones of the terminal pairs. That is, the ground terminal G1 is arranged between the terminal pair of the terminals S1, S2 and the terminal pair of the terminals S3, S4, and similarly, the ground terminal G2 is arranged between the terminal pair of the terminals S5, S5 and the terminal pair of the terminals S7, S8. By such arrangement of the ground terminals G1, G2, occurrence of crosstalk between the terminal pairs can be reduced.

Each ground terminal is arranged between the terminal pairs as described above. Thus, an electric adverse effect which might occur between the terminal pairs in high-speed transfer can be specifically reduced, and electric characteristics can be improved.

As in the terminal mounting portion 122 of each terminal of the terminal group 120 illustrated in FIG. 4, a terminal mounting portion 162 of each terminal of the terminal group 160 is formed in such a manner that a back end side portion of each of the terminals S1 to S8 and the ground terminals G1, G2 is bent downward in the perpendicular direction (the Z-axis direction) and a back end side portion with respect to such a bent portion is further bent horizontal (parallel) to a substrate toward the back side (the X1 side). In the terminal group 160, back end portions (end portions on the X1 side) of the terminals S1 to S8 and the ground terminals G1, G2 are arranged at positions on a straight line when the terminal group 160 is viewed from the lateral direction (the Y-axis direction). That is, the terminal mounting portions 162 of the terminals can be configured with the same length. Alternatively, as in the variations illustrated in FIGS. 8 and 9, the length of each of the terminal mounting portions 162 of the signal terminals S1 to S8 can be changed.

INDUSTRIAL APPLICABILITY

The connector according to the present invention can be utilized when devices are connected via a cable for transferring a high-frequency electric signal by an electronic device such as a measurement device configured to handle a high-frequency signal.

LIST OF REFERENCE NUMERALS

1, 2, 3, 4, 5, 6, 7, 8 Terminal
S1, S2, S3, S4, S5, S6, S7, S8 Terminal
G1, G2 Ground terminal
11, 12, 13, 14, 15, 16, 17, 18 Terminal mounting portion
21, 22, 23, 24, 25, 26, 27, 28 Terminal mounting portion
100 Connector
102 Fitting recessed portion
104 Fitting raised portion
106 Outer conductor shell
108 Shell mounting portion
110 Lock hole
112 Insulator
120 Terminal group
122 Terminal mounting portion
124 Contact portion
126 Bent portion
128 Bent portion
130 Bent portion
132 Terminal mounting portion
140 Terminal group
142 Terminal mounting portion
150 Terminal group
152 Terminal mounting portion
160 Terminal group
162 Terminal mounting portion
200 Connector
202 Fitting portion
204 Outer conductor shell
206 Lock protrusion
208 Lock operation button
210 Cover member
300 Substrate
400 Cable

The invention claimed is:

1. A connector comprising:
an outer conductor shell;
a terminal group including at least two or more terminal pairs of two terminals; and
an insulator housed in the outer conductor shell with the insulator holding the terminal group, wherein
each terminal of the terminal pair included in the terminal group includes
at a tip end side portion of the connector, a contact portion to be connected in contact with a terminal of a partner connector, and
at a back end side portion of the connector, a terminal mounting portion to be mounted on a substrate,
the contact portions are arranged adjacent to each other in a direction perpendicular to the substrate,
the terminal mounting portions are arranged adjacent to each other in a direction horizontal to the substrate,
each terminal of the terminal pair includes, in an order from the contact portion to the terminal mounting portion, at least a first bent portion at which the terminal pair extending in a connector fitting direction is bent in a direction toward the substrate, and a second bent portion at which the terminal pair extending toward the substrate after the first bent portion is bent in parallel with the substrate in a direction perpendicular to the connector fitting direction, and
the terminals of each terminal pair are arranged in parallel along shapes thereof.

2. The connector according to claim 1, wherein
the contact portion of one terminal of the two terminals included in the terminal pair is arranged above the contact portion of the other terminal, and
the terminal mounting portion of the one terminal is arranged inward of the connector with respect to the terminal mounting portion of the other terminal.

3. The connector according to claim 1, wherein
the terminal mounting portion of the one terminal has a same length as that of the terminal mounting portion of the other terminal, and
end portions of the terminal mounting portions are arranged at positions on a straight line as viewed from the direction in which the terminal mounting portions are arranged adjacent to each other.

4. The connector according to claim 1, wherein
the terminal mounting portion of the one terminal is configured longer or shorter than the terminal mounting portion of the other terminal.

5. The connector according to claim 1, wherein
the terminal group includes two or more terminal pairs,
the terminal mounting portion of each terminal included in one terminal pair is configured longer or shorter than the terminal mounting portion of each terminal included in the other terminal pair, and
the terminal mounting portions of the two terminals included in the terminal pair have an identical length.

6. The connector according to claim 1, wherein
each terminal of the terminal pair includes a third bent portion on a mounting portion side with respect to the second bent portion, and
at the third bent portion, each terminal of the terminal pair extending outward of the connector in the direction perpendicular to the connector fitting direction after the first bent portion and the second bent portion is bent backward along the connector fitting direction.

7. The connector according to claim 6, wherein
the terminal mounting portions are exposed through a back portion of the outer conductor shell on an opposite side of a side to be fitted in the partner connector.

8. A connector manufacturing method for manufacturing the connector according to claim 6, comprising at least:
a step of cutting out the terminal pair from a metal plate such that the first bent portions and the third bent portions are formed on an same plane; and
a step of perpendicularly bending a portion between the each first bent portion and the each second bent portion in each cutout terminal pair to form the second bent portion between the first bent portion and the third bent portion.

9. The connector according to claim 1, wherein
the terminals included in the terminal pair are arranged adjacent to each other on an same plane.

10. The connector according to claim 1, wherein
each terminal included in the terminal pair is held in such a manner that part of the each terminal is covered by integral molding with the insulator.

11. The connector according to claim 1, wherein
the terminal group includes an even-number of terminal pairs, and
a half of the even-number of the terminal pairs and the remaining half of the even-number of the terminal pairs are arranged to face each other along the connector fitting direction.

12. The connector according to claim 1, wherein
the terminal group includes four terminal pairs including eight terminals.

13. The connector according to claim 1, wherein
the terminal group includes four terminal pairs including eight terminals, and two ground terminals, and
the each ground terminal is arranged between adjacent ones of the terminal pairs.

14. The connector according to claim 1, wherein
the terminal mounting portions are exposed through a side portion of the connector in a direction perpendicular to an outer conductor shell fitting direction.

15. The connector according to claim 1, wherein
the terminal mounting portions have a shape bent in a single-step shape such that surface-mounting of the terminal mounting portions on the substrate is allowed.

16. A connector manufacturing method for manufacturing the connector according to claim 1, comprising at least:
a step of cutting out the terminal pair with the first bent portions from a metal plate; and
a step of perpendicularly bending back end side portions of the cutout terminal pair with respect to the first bent portions to form the second bent portions.

17. A connector comprising:
an outer conductor shell;
a terminal group including a first terminal pair of two terminals and a second terminal pair of two terminals; and
an insulator housed in the outer conductor shell with the insulator holding the terminal group, wherein
each terminal of the first terminal pair and the second terminal pair included in the terminal group includes
at a tip end side portion of the connector, a contact portion to be connected in contact with a terminal of a partner connector,
at a back end side portion of the connector, a terminal mounting portion to be mounted on a substrate, and
a first bent portion at which the terminal extending in a connector fitting direction is bent in a direction toward the substrate,
the contact portions are arranged adjacent to each other in a direction perpendicular to the substrate,
the terminal mounting portions are arranged adjacent to each other in a direction horizontal to the substrate, and
the first bent portion of the each terminal of the first terminal pair and the second terminal pair is configured such that intervals between the each terminal of the first terminal pair and the second terminal pair are held constant.

18. The connector according to claim 17, wherein
each terminal of the first terminal pair and the second terminal pair further includes a second bent portion at which the terminal pair extending toward the substrate after the first bent portion is bent in parallel with the substrate in a direction perpendicular to the connector fitting direction, and
the second bent portion of the each terminal of the first terminal pair and the second terminal pair is configured such that intervals between the each terminal of the first terminal pair and the second terminal pair are held constant.

* * * * *